US008528271B1

(12) United States Patent
Hemmer

(10) Patent No.: US 8,528,271 B1
(45) Date of Patent: Sep. 10, 2013

(54) MULTI-MODULE VENT COVER SYSTEM FOR A ROOF VENTILATION VENT

(76) Inventor: Michael Hemmer, Lauderhill, FL (US)

( * ) Notice: Subject to any disclaimer, the term of this patent is extended or adjusted under 35 U.S.C. 154(b) by 0 days.

(21) Appl. No.: 13/470,960

(22) Filed: May 14, 2012

Related U.S. Application Data

(63) Continuation-in-part of application No. 12/263,173, filed on Oct. 31, 2008, now abandoned.

(60) Provisional application No. 60/984,000, filed on Oct. 31, 2007.

(51) Int. Cl.
*E04B 7/18* (2006.01)

(52) U.S. Cl.
USPC ..... 52/95; 52/101

(58) Field of Classification Search
USPC ..... 52/94, 95, 101, 198, 202, DIG. 12; 454/260, 275, 276, 367
See application file for complete search history.

(56) References Cited

U.S. PATENT DOCUMENTS

| | | | | |
|---|---|---|---|---|
| 2,525,371 | A * | 10/1950 | Reynolds, Sr. | 454/276 |
| 2,718,187 | A * | 9/1955 | Frisby | 454/260 |
| 2,821,895 | A * | 2/1958 | Allabaugh | 454/276 |
| 2,834,278 | A * | 5/1958 | Crute, Jr. | 454/276 |
| 3,232,205 | A * | 2/1966 | Bumstead | 454/260 |
| 4,502,368 | A * | 3/1985 | Hempel | 454/277 |
| 4,676,145 | A * | 6/1987 | Allred | 454/276 |
| 5,547,422 | A * | 8/1996 | Seboldt | 454/359 |
| 5,918,430 | A * | 7/1999 | Rowland | 52/202 |
| 7,556,560 | B2 * | 7/2009 | Janesky | 454/276 |
| 2006/0010792 | A1 * | 1/2006 | Biggers | 52/202 |
| 2007/0028536 | A1 * | 2/2007 | Pandorf | 52/203 |

* cited by examiner

*Primary Examiner* — Christine T Cajilig
(74) *Attorney, Agent, or Firm* — Gold & Rizvi, P.A.; H. John Rizvi

(57) ABSTRACT

A multi-module vent cover system for installation onto a roof ventilation vent is provided, including both a solid module and a screen module that are cooperatively useable to cover a roof vent. The screen module is designed to permanently cover the ventilation vent and is designed with a mesh sized to exclude the animal or animals of interest from access into the roof and/or attic. The solid module is configured with holes adapted to receive fastening studs extending from the screen module, allowing for removable mounting of the solid module over the screen module when needed. The solid module is designed to removably cover the ventilation vent to prevent a pressure differential, flying debris damage and water intrusion during hurricanes, to prevent airborne embers from entering during a firestorm, and to protect the screen module against accidental paint splatters.

11 Claims, 9 Drawing Sheets

PRIOR ART

MULTI-MODULE VENT COVER SYSTEM FOR A ROOF VENTILATION VENT

CROSS-REFERENCE TO RELATED APPLICATIONS

This Continuation-in-Part application claims the benefit of co-pending U.S. patent application Ser. No. 12/263,173 filed on Oct. 31, 2008, which claimed the benefit of Provisional Patent Application Ser. No. 60/984,000, filed on Oct. 31, 2007, which are incorporated herein in their entirety.

FIELD OF THE INVENTION

The present invention relates generally to the building industry, and more particularly, but not by way of limitation, relates to a multi-module cover for a roof ventilation vent, including both a screened module to prevent the intrusion of insects, rodents, squirrels, bats, or other animals and a solid module to protect the vent and/or roof from wind, water, flying debris, and/or airborne embers from hurricanes, storms, and wildfires.

DESCRIPTION OF THE PRIOR ART

Adequate roof ventilation is important for both residential and commercial buildings. It saves money on air-conditioning, helps prevent ice dams caused by uneven heat distribution, and provides fresh air to prevent condensation, mold, and mildew problems in the roof and/or attic. Therefore, a conventional building construction practice is to install sufficient roof ventilation vents, for example, soffit vents (intake vents) in the lower border of a roof that overhangs the wall and gable end vents (exhaust vents) at the end of a pitched roof (as illustrated in FIG. 1).

While roof ventilation is essential for optimum functioning of a house or building, at times soffit vents, gable end vents, and other roof ventilation vents can prove to be a detriment to that same house or building. For example, hurricanes or other intense storms regularly produce a strong wind blowing from one direction. The high pressure from the substantially unidirectional wind forces air into the vents on one side of the building with such force that the vents on the opposing side of the building may not be adequate to relieve the pressure, thus resulting in damage or destruction of the roof and/or ceiling. This often occurs either because the building was constructed with more vents on one side than on the opposing side, or because the vents on one side are blocked by debris or insulation. Damage can occur when the net free air flow allowed to escape on the low pressure, leeward side of the building does not equal the net free air flow entering the roof on the high pressure, windward side of the building. Additionally, even though roof ventilation vents may have louvers or baffles designed to keep water out, they are not designed to keep out water driven by hurricane force winds, so may allow water to intrude into the roof, walls, or attic. Testing has shown that winds of over 90 mph may even drive water through the soffit vents under the eaves. Additionally, roof ventilation vents can be damaged by flying debris propelled by severe winds, necessitating expensive repairs.

Another problem with conventional roof venting occurs in wildfires. Airborne embers, transported by winds or breezes, can be drawn into the vents as the vents are functioning in a normal manner by drawing air into the roof.

It would be advantageous to provide an easily attachable and easily removable, economical, non-permeable solid cover that could prevent wind and water from entering the exposed soffit, gable, and other roof ventilation vents during hurricanes and intense storms, that could prevent damage to the roof ventilation vents from flying debris, and that could prevent airborne embers from entering during wildfires. It would also be advantageous to have a non-permeable cover for covering vents during painting of the vent area to protect the vent from accidental paint spatters—saving time and effort in clean up and paint removal. Additionally, it would be an advantage for the non-permeable cover to be easily removable during normal conditions to allow proper roof ventilation.

A further problem with conventional roof venting concerns the exclusion of rodents, birds, squirrels, insects, and the like. Conventional roof vents could be improved by introducing a mesh cover that will exclude animals and/or insects, with the size of the mesh dependant on the animal or insects to be excluded. An economical mesh screen vent cover that can be utilized in new construction and that is cooperatively usable with a solid cover, providing a convenient method of attachment for the solid cover, as presented in the instant invention, is desirable.

Thus, with the need for a porous vent cover with a mesh appropriately sized for exclusion of the animals of interest and with the need in some situations for a removable solid vent cover, the current invention of an easy-to-install and easy-to-remove system providing a solid vent cover module and a screen vent cover module that are cooperatively useable is an advantageous solution to current roof ventilation problems.

Accordingly, there is an established need for a convenient, economical, multi-module vent cover system for a roof ventilation vent that provides a permanently installed screen module to prevent the intrusion of insects, rodents, squirrels, bats, or other animals that may gain access to the roof and/or attic and also provides an easy-to-attach and easy-to-remove solid module to removably cover the screen module to prevent a pressure differential, flying debris damage, water intrusion, airborne embers, and accidental paint splatters.

SUMMARY OF THE INVENTION

The present invention is directed toward a multi-module vent cover system for installation onto a roof ventilation vent including both a solid module and a screen module that are cooperatively useable to cover a roof vent, and are especially adapted for new construction. The solid module is configured with holes adapted to receive fastening studs extending from the screen module allowing removable mounting of the solid module over the screen module. The solid module is designed to removably cover the ventilation vent to prevent a pressure differential, flying debris damage, and water intrusion during hurricanes, to prevent airborne embers from entering during a firestorm, and to protect the vent against accidental paint splatters. The screen module is designed to permanently cover the ventilation vent and is designed with a mesh sized to exclude the animal or animals of interest from access into the roof and/or attic.

An object of the present invention is to provide a multi-module vent cover system for a roof ventilation vent that can be adapted for use with a wide variety of conventional roof ventilation vents.

A further object of the present invention is to provide a multi-module vent cover system for a roof ventilation vent that is economical to use.

Another object of the present invention is to provide a multi-module vent cover system for a roof ventilation vent that includes a solid module that is configured to easily attach and easily detach to the screen module over the roof ventilation vent area.

An additional object of the present invention is to provide a multi-module vent cover system for a roof ventilation vent will guard the screen module from wind, water, flying debris, fire embers, and/or paint splatters.

A further object of the present invention is to provide a multi-module vent cover system for a roof ventilation vent that will exclude an animal or animals of interest from the roof and/or attic.

These and other objects, features, and advantages of the present invention will become more readily apparent from the attached drawings and from the detailed description of the preferred embodiments, which follow.

BRIEF DESCRIPTION OF THE DRAWINGS

The preferred embodiments of the invention will hereinafter be described in conjunction with the appended drawings, provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

Shown throughout the figures, the present invention is directed toward a convenient multi-module vent cover system 10 for installation onto a roof ventilation vent including both a permanently attached solid module 60 and an attachable screen module 70 that in combination are adapted to be utilized with a variety of shapes and styles of roof vents, and are particularly adapted for new construction or reconstruction of roof vents.

The solid module 60 of the multi-module vent cover system 10 is designed to removably cover the ventilation vent to prevent a pressure differential, flying debris damage, and water intrusion during hurricanes, to prevent airborne embers from entering during a firestorm, and to protect the vent against accidental paint splatters. The screen module is designed to provide an attachment point for the solid module while permanently covering the ventilation vent to prevent the intrusion of insects, rodents, squirrels, bats, or other animals may try to gain access to the roof and/or attic.

Figure 1:
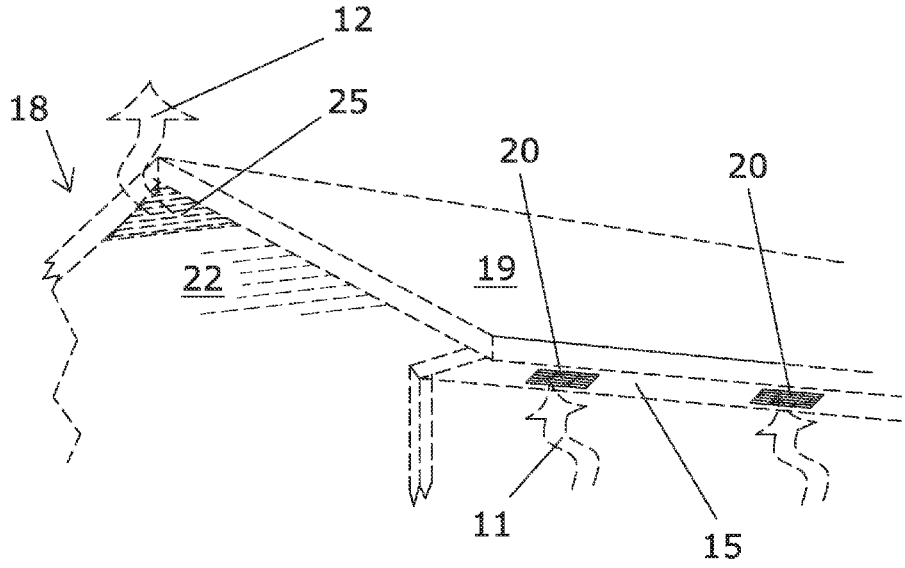
FIG. 1 is a perspective view of a building, showing airflow in a conventional roof ventilation system of the prior art.

Referring now to FIG. 1, there is illustrated a building in the form of a residential dwelling or house 18, representing an exemplary conventional application of roof ventilation vents, having a louvered gable end vent 25 installed in a gable end 22 of the house 18 and having a louvered soffit vent 20 installed under the eaves on a horizontally projecting soffit 15 of the house 18. The intake airflow 11 flows into louvered soffit vent 20, allowing the uptake of fresh air which passes through the roof 19 area, allowing exhaust airflow 12 from within the structure to escape to the atmosphere via gable end vent 25. The intake airflow 11 and exhaust airflow 12 may either be designed to operate in an active manner with a conventional device increasing the amount of airflow or to operate in a passive manner. Although in general such a typical roof ventilation process is beneficial, in particular situations it is desirable to temporarily cover the roof ventilation vents 20, 25. To this end is provided the solid module 60 of the multi-module vent cover system 10. There is also a need to exclude particular animals of interest from access to the roof or attic area through the ventilation vent. To this end is provided the screen module 70 of the multi-module vent cover system 10, preferably replacing the louvers.

Figure 2A:
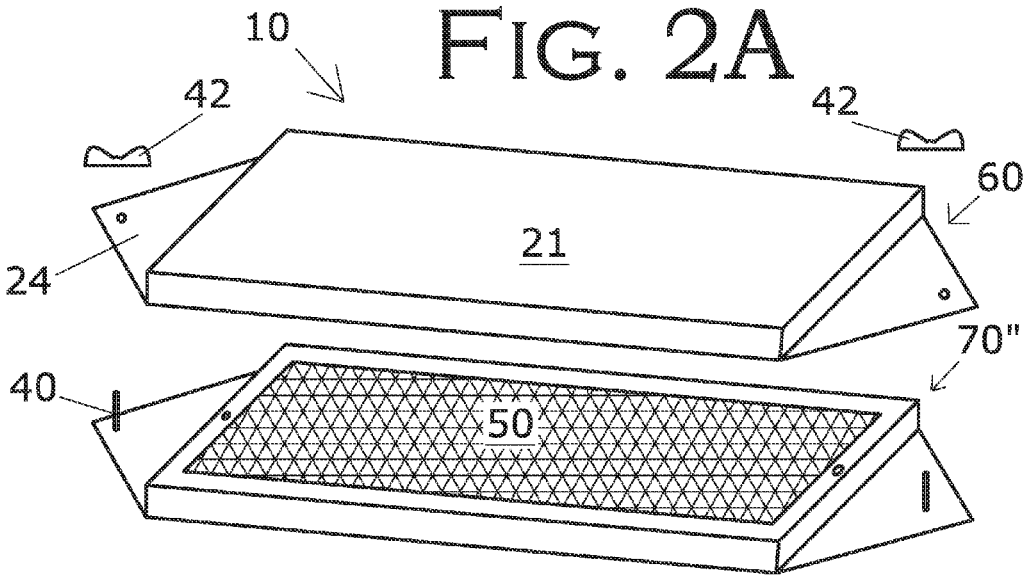
FIG. 2A is a perspective view showing a first preferred embodiment of a small-sized screen module, utilizing a medium-sized screen module[,] having a screen with medium-sized openings and a solid module of the multi-module vent cover system for a roof ventilation vent of the present invention.
Figure 2B:
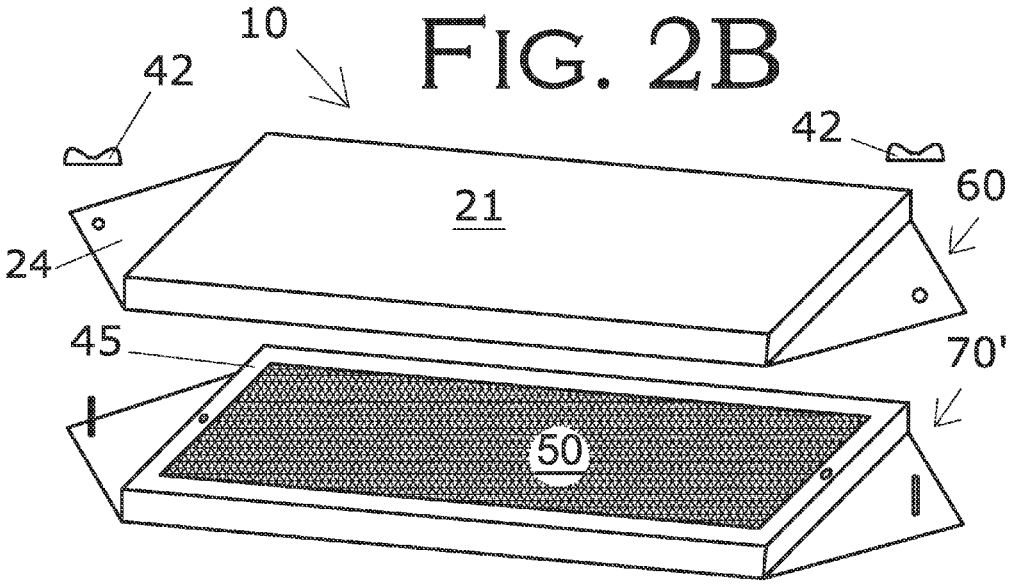
FIG. 2B is a perspective view showing a first preferred embodiment utilizing a small-sized screen module having a screen with small-sized openings and a solid module of the multi-module vent cover system for a roof ventilation vent of the present invention.
Figure 3:
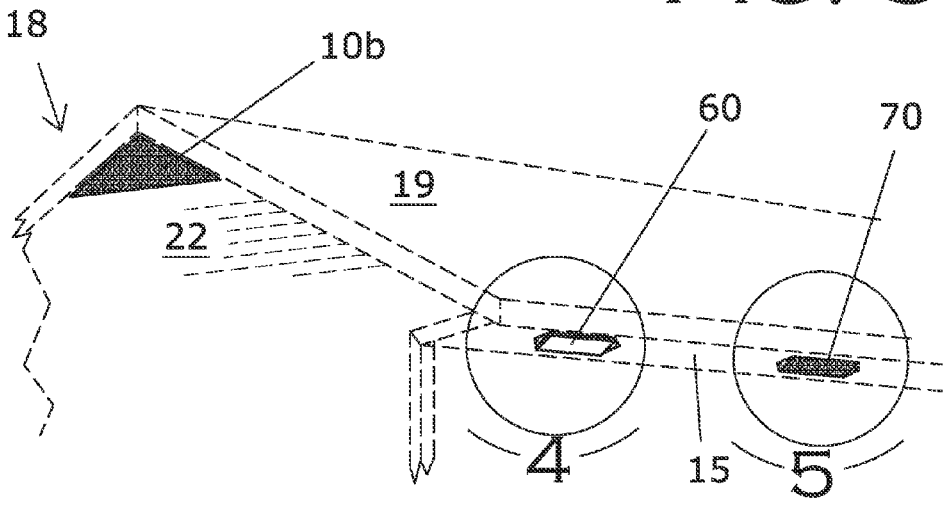
FIG. 3 is a perspective view showing a first preferred embodiment of a rectangular screen module and a rectangular solid module and showing a second preferred embodiment of a triangular screen module of the multi-module vent cover system for a roof ventilation vent of the present invention, illustrating their application over soffit vents and over a gable end vent on the exterior of a building.

The multi-module vent cover system 10 includes a solid module 60 used with a screen module 70 of the multi-module vent cover system 10 are illustrated in FIG. 2. The screen module 70 may be a medium-size screen module 70 having a more open mesh (as shown in FIG. 2A) or a small-size screen module 70 having a finer mesh (as shown in FIG. 2B). The screen module 70 is illustrated with two exemplary varying sizes of screen mesh to demonstrate the potential variability of the screen mesh size to meet the need to exclude particular animals of interest. For example, to exclude insects the smaller mesh of 70' would preferably be chosen, while to exclude rodents and allow greater air circulation, the larger mesh (1 centimeter or over) of 70" would preferably be chosen. The screen module 70 is illustrated with two exemplary varying sizes of screen mesh to demonstrate the potential variability of the screen mesh size to meet the need to exclude particular animals of interest. For example, to exclude insects the smaller mesh of 70' would preferably be chosen, while to exclude rodents and allow greater air circulation, the larger mesh (1 centimeter or over) of 70" would preferably be chosen.

The screen module 70 is designed to be permanently installed, preferably during new construction of the building or reconstruction of the vent area, over the opening forming the ventilation vent 20, 25, such as is generally formed by rafters 32. The screen module 70 is configured with projecting fastening studs 40 onto which the solid module 60 may be removably secured over screen module 70.

As illustrated in the first embodiment of FIGS. 2A, 2B, 3, 4, 6, and 7 the solid module 60 includes a substantially solid-module planar base member 21, four solid-module planar side members 26, 28, 36, 38, and a planar first and second solid-module securing member 24, 34.

For efficiency of manufacture, solid module 60 is preferably a unitarily molded unit of metal or plastic or other polymer. However, it is not required that solid module 60 be constructed as a unitary structure; in alternative, it may be formed of individual members and bonded together or mechanically joined together by conventional means.

In the first embodiment of FIG. 2A to FIG. 8, the solid-module planar base member 21 is substantially rectangular and is provided in a length and width slightly larger than the length and width of the screen module 70.

Solid-module first longitudinal side member 28 (FIG. 6) and solid-module second longitudinal side member 38 (FIG. 4, FIG. 6) are preferably formed integrally with (or, less preferably, joined to) the opposing longitudinal edges of solid-module planar base member 21, substantially forming a right angle. A first solid-module lateral side member 26 (FIG. 4, FIG. 7) and an opposing second solid-module lateral side member 36 (FIG. 7) are preferably formed integrally with (or, less preferably, joined to) the opposing lateral edges of solid-module planar base member 21, substantially forming a right angle. The depth that the first solid-module lateral side member 26, second solid-module lateral side member 36, first solid module longitudinal side member 28, and second solid module longitudinal side member 38 extend from solid-module planar base member 21 is slightly larger than the distance that screen module 70 protrudes.

The first solid-module securing member 24 and the second solid-module securing member 34 are preferably formed integrally with, or alternatively, joined to, the distal edges of first solid-module lateral side member 26 and second solid-module lateral side member 36, respectively, substantially forming a right angle, and therefore, are in a plane substantially parallel to the solid-module planar base member 21. First solid-module securing member 24 and second solid-module securing member 34 are configured with holes 14 (FIG. 7) adapted to receive a fastening stud 40. Holes 14 are generally disposed in a peripheral location, as illustrated. The solid module 60 is secured over screen module 70 via nuts 42 engaged on fastening studs 40. The number, size, configuration, and positioning of the holes 14 may be varied as required to secure the solid module 60 over screen module 70.

Figure 4:
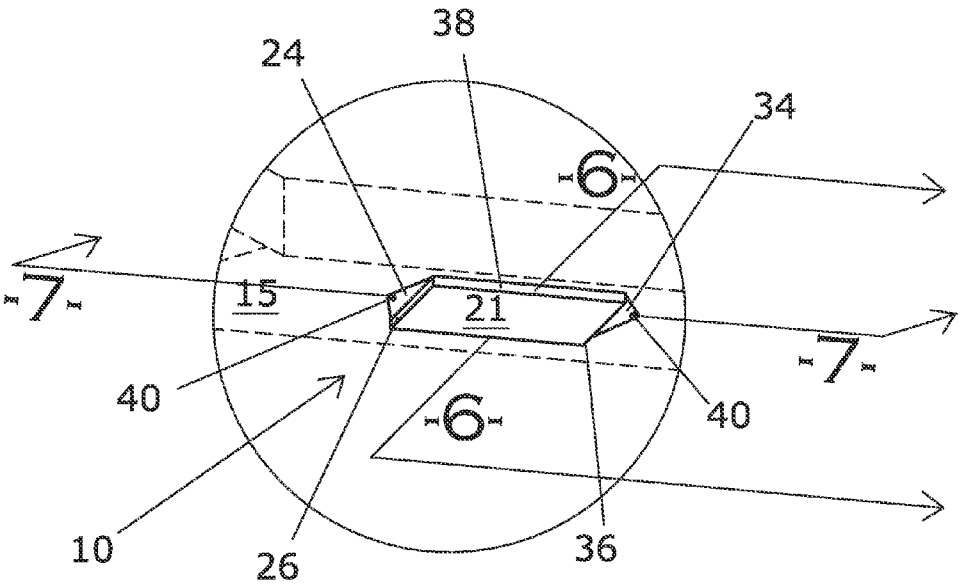
FIG. 4 is a detail perspective view, taken of circle 4 of FIG. 3, of the solid module of the first embodiment of the multi-module vent cover system for a roof ventilation vent of the present invention as installed over a soffit vent.

Preferably first solid-module securing member 24 and second solid-module securing member 34 are triangular with the wider base of the triangle shape attached to the edge of first lateral side member 26 and second lateral side member 36, respectively 9 (FIG. 4). The attachment of the wider base of the triangle to the lateral side members 26, 36 provides robustness and strength, while the narrower apex configured with hole 14 is compact, yet strong enough to allow convenient attachment via nuts 42 and fastening studs 40. Additionally, the exterior edges of the solid-module securing members 24, 34 and of the longitudinal side members 28, 38 may be formed with rounded outward edges to promote safety during removal and installation. The rounded edges may be formed by rolling the edges, grinding the edges to achieve smoothness, or the like.

Turning now to the underlying and permanently installed screen module 70 onto which solid module 60 is removably attachable, screen module 70 includes a substantially rigid exterior frame member 45 (FIG. 2B, FIG. 5), a foraminous intermedial screen member 50 fitted within the frame member 45, a planar first screen-module securing member 61 configured with a first fastening stud 40*a*, and a second screen-module securing member 62 configured with a second fastening stud 40*b*.

Figure 6:
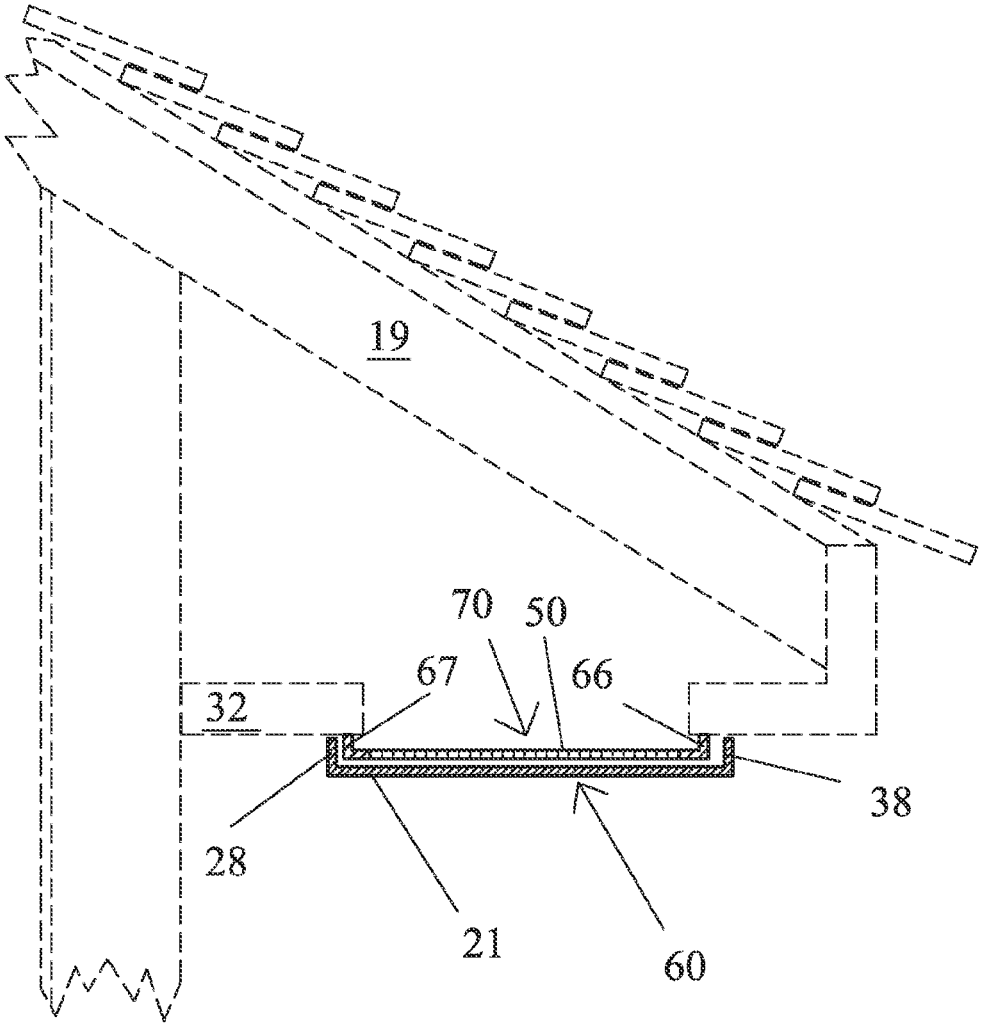
FIG. 6 is a cutaway end view along the lines of 6-6 of FIG. 4 of the solid module and screen module of the first embodiment of the multi-module vent cover system for a roof ventilation vent of the present invention, illustrating installation over a soffit vent.
Figure 7:
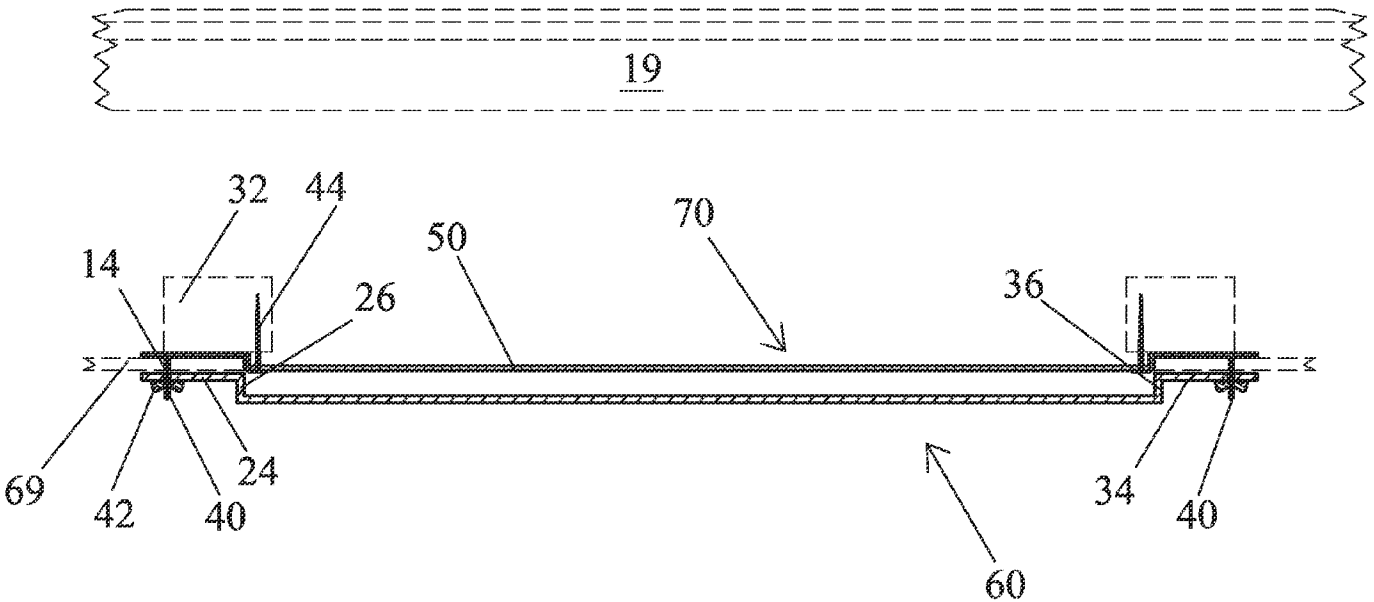
FIG. 7 is a cutaway side view along the lines of 7-7 of FIG. 4 of the solid module and screen module of the first embodiment of the multi-module vent cover system for a roof ventilation vent of the present invention, illustrating its installation over a soffit vent.

The frame member 45 is generally thin and forms an exterior framework defining an interior central air flow space. The frame member 45 may be formed of a metal, a polymer, wood, or the like, but is preferably formed of a lightweight metal, such as aluminum. Frame member 45 comprises two generally thin, rigid lateral members 63, 64 (FIG. 8) and two generally thin, rigid longitudinal members 66, 67 (FIG. 6).

The planar first screen-module securing member 61 and second screen-module securing member 62 are substantially rigid, thin, planar, and generally triangular, being substantially parallel to the screen member 50. Both the planar first screen-module securing member 61 and the second screen-module securing member 62 are configured with a fastening stud 40, which preferably takes the form of a permanently attached bolt or stud. One of fastening studs 40 is securely attached to and projects downwardly from the planar first screen-module securing member 61 and another from the second screen-module securing member 62. Fastening stud 40 may be pressed into the planar first screen-module securing member 61 and the second screen-module securing member 62, or attached in a similar secure manner. Preferably the extending end of fastening stud 40 is configured with machine screws to allow easy engagement and tightening of a corresponding nut 42 (FIG. 7), after the solid module 60 is positioned over the mesh screen module 70 and the fastening studs 40 are inserted into the holes 14 of solid module 60. Preferably the nut 42 will be a wing nut for ease of application if a manual installation and removal of the solid module 60 is anticipated.

Figure 5:
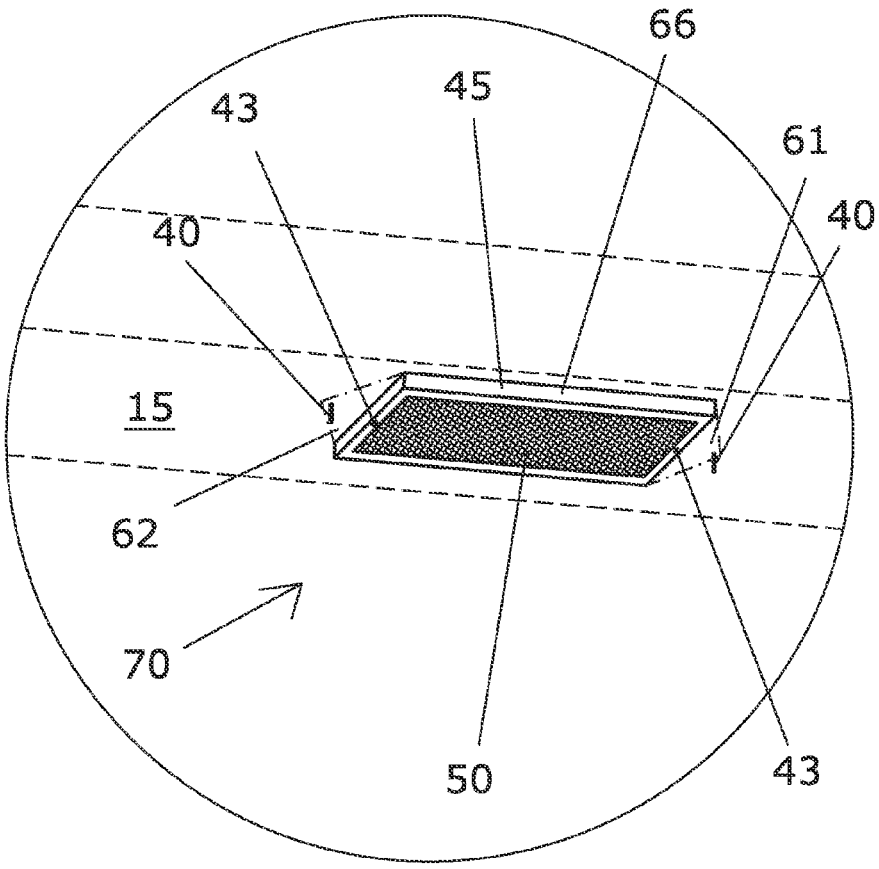
FIG. 5 is a detail perspective view, taken of circle 5 of FIG. 3, of the screen module of the first embodiment of the multi-module vent cover system for a roof ventilation vent of the present invention as installed over a soffit vent.
Figure 8:
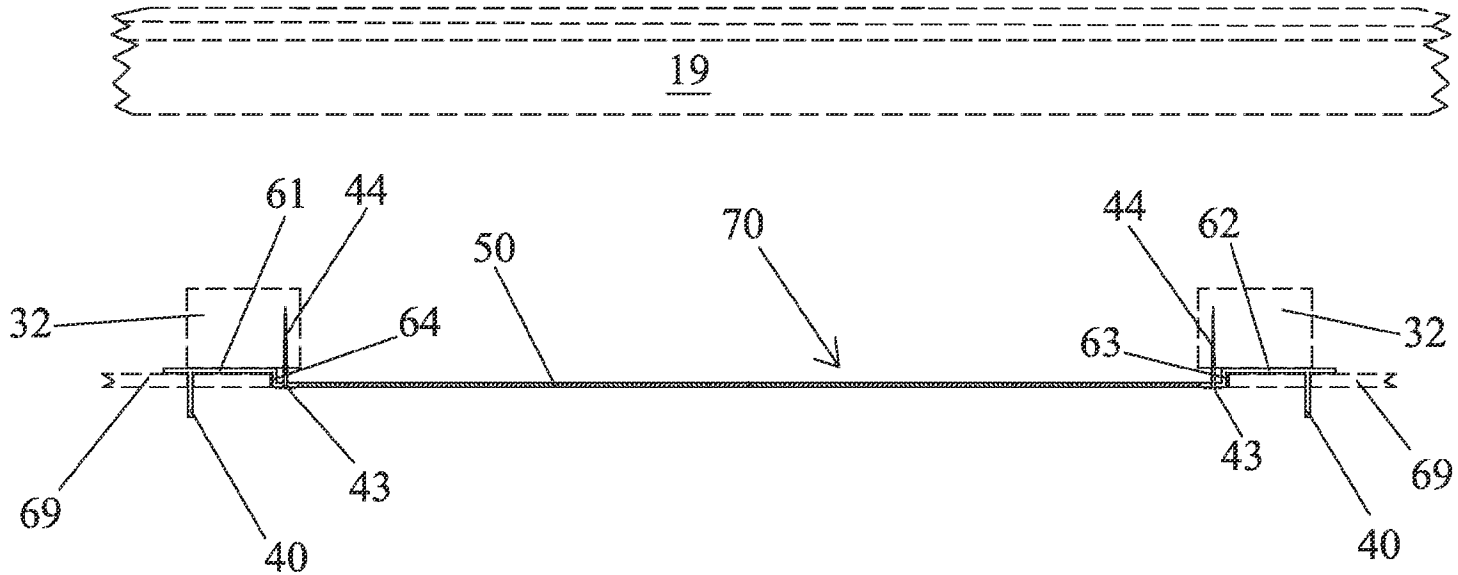
FIG. 8 is a cutaway side view, as in FIG. 7 but without the solid module installed, of the screen module of the first embodiment of the multi-module vent cover system for a roof ventilation vent of the present invention, illustrating its installation over a soffit vent.

The frame member 45 is configured with securing holes 43 (FIG. 5, FIG. 8) used to fasten the frame member 45 over the ventilation vent via utilization of frame fasteners 44 (FIG. 5, FIG. 8). Frame fasteners 44 can be screws, nails, or other conventional fastening modalities, with the type of fastener chosen dictated by the material at the exterior of the ventilation vent to which the screen module 70 will be secured. For example, if the area at the exterior of the ventilation vent is wood, such as rafters 32, preferably the frame fasteners 44 would be wood screws or nails. Frame fasteners 44 are illustrated as nails in FIG. 7, FIG. 8.

For efficiency of manufacture, the exterior frame member 45, planar first screen-module securing member 61, and second screen-module securing member 62 are preferably a unitarily molded unit of metal or plastic or other polymer. However, it is not required that the frame member 45, planar first screen-module securing member 61, and second screen-module securing member 62 be constructed as a unitary structure; in alternative, the planar first screen-module securing member 61 and the second screen-module securing member 62 may be formed of individual members and mechanically joined or adhesively bonded to frame member 45 by conventional means.

The intermedial screen member 50 is formed of a porous material to allow air flow through the central air flow space defined by frame member 45. Preferably the material forming screen member 50 provides apertures of a generally consistent size, with the aperture size dictated by consideration of the particular animal or animals to be excluded by the screen member 50. The material forming screen member 50 may be any conventional screen or mesh material, such as, for example, wire mesh, woven wire mesh, wire mesh screen, woven wire cloth, wire cloth, wire cloth screen, wire weaving, metal cloth, welded wire fabric, or the like composed of fiberglass or other synthetic fiber, aluminum, vinyl-coated polyester, stainless steel, copper, or other corrosion resistant alloys, or the like.

The intermedial screen member 50 extends within the frame member 45 to the inside edges of frame member 45, being securely attached to frame member 45, preferably in a replaceable manner. The screen member 50 may be attached to frame member 45 in any conventional manner replaceable manner, such as, for example, frame member 45 may be configured with a grove along its interior edge into which the edges of the screen member 50 are pressed and held by a conventional spline or rubber-like strip, as is common in screen installations. Less preferably screen member 50 may be permanently attached to frame member 45, such as by adhesives.

To use the multi-module vent cover system 10 of the present invention, the screen module is securely attached over a roof ventilation vent via frame fasteners 44, preferably during new construction of a building or during remodeling or reconstruction of the soffit area. Frame fasteners 44 are installed through holes 43 in the frame member 45. Then a layer of building materials such as plaster, stucco, or plywood 69 (FIG. 8) is preferably installed over the planar first screen-module securing member 61 and over the second screen-module securing member 62 with the fastening stud 40 on both the planar first screen-module securing member 61 and on the second screen-module securing member 62 extending through the plaster or plywood 69 with sufficient extension to allow for attachment of the solid module 60 via nut 42. Thus the screen module is preferably permanently installed.

When desired or needed, the solid module 60 of the multi-module vent cover system 10 of the present invention can be removably installed over the screen module 70. The solid module 60 is placed over the soffit vent 20 in a position that allows the installed fastening studs 40 extending from the screen module 70 to extend through the peripheral holes 14 of the first solid-module securing member 24 and the second solid-module securing member 34. Solid module 60 is then secured by engaging and tightening a corresponding nut 42 on each of the fastening studs 40. When desired, to remove the solid module 60, the nuts 42 are un-tightened and disengaged from fastening mechanisms 40.

The permanent mounting of a fastening stud 40 provides for convenient repeated use of the solid module 60 of the multi-module vent cover system 10. For example, the above steps to install the solid module can be performed for hurricane preparation; then after removal the solid module 60 can be stored until needed again, and then the above installation steps can be repeated for a second hurricane preparation, a wild fire risk, etc.

FIG. 9, FIG. 10, FIG. 11, and FIG. 12 illustrate a second, third, fourth, and fifth exemplary embodiment of the solid module 60 of the present invention. The second, third, fourth, and fifth exemplary embodiments of the solid module 60 are substantially similar to, and function in a similar manner to, the solid module 60 of the first exemplary embodiment of FIG. 2A to FIG. 7, but illustrate the exemplary variations of shape to accommodate the conventional roof ventilation vents commercially available, and therefore, necessarily have a variation in the number of side members, in the structure of first solid-module securing member 24 and second solid-module securing member 34, and in the position of the holes 14 in the solid-module securing members.

Figure 9:
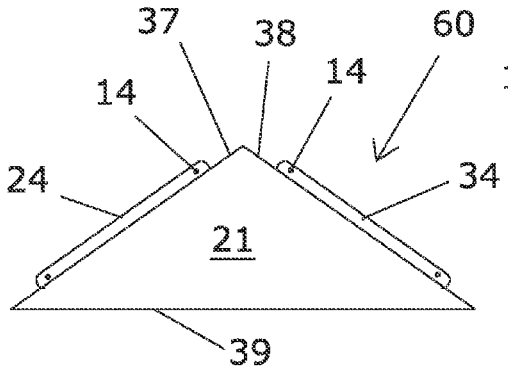
FIG. 9 is a top view showing the solid module 60 of the second preferred embodiment of the roof ventilation vent cover of the present invention.
Figure 13:
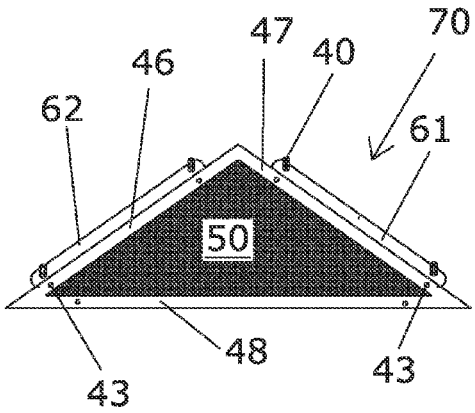
FIG. 13 is a top view showing the screen module 70 of the second preferred embodiment of the roof ventilation vent cover of the present invention.

The solid module 60 of FIG. 9 illustrates a triangular shape configured to fit over and to cover the screen module 70 of FIG. 13, such as gable end vent 25, so therefore, has only three side members, 37, 38, and 39. First solid-module securing member 24 and second solid-module securing member 34 are disposed on side member 37 and side member 38 and are configured with holes 14 to receive fastening studs 40, in a similar manner to the first embodiment. Although illustrated with only two solid-module securing members, an additional third solid-module securing member can be provided, if desired, for additional support.

Figure 10:
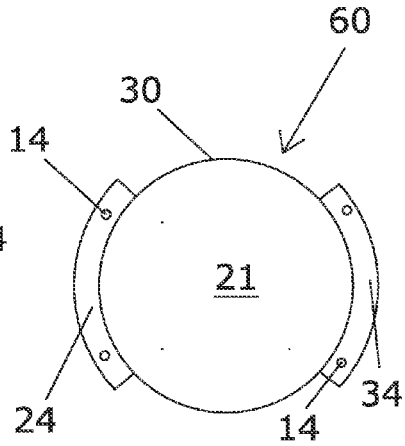
FIG. 10 is a top view showing the solid module 60 of the third preferred embodiment of the roof ventilation vent cover of the present invention.
Figure 14:
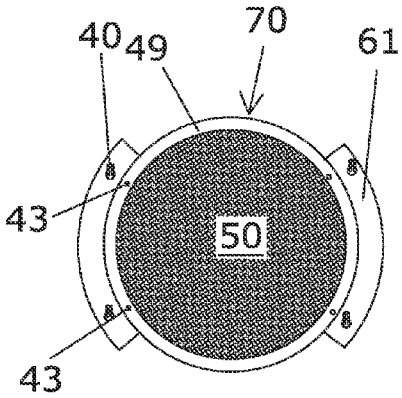
FIG. 14 is a top view showing the screen module 70 of the third preferred embodiment of the roof ventilation vent cover of the present invention.

The solid module 60 of FIG. 10 illustrates a circular shape configured to fit over and to cover the screen module 70 of FIG. 14, so first lateral side member 26, second lateral side member 36, first longitudinal side member 28, and second longitudinal side member 38 are preferably joined to form a preferably continuous circular side member 30. First solid-module securing member 24 and second solid-module securing member 34 are disposed on opposite sides of the circularly shaped roof solid module 60 and configured with holes 14 to receive fastening studs 40, in a similar manner to the first embodiment.

Figure 11:
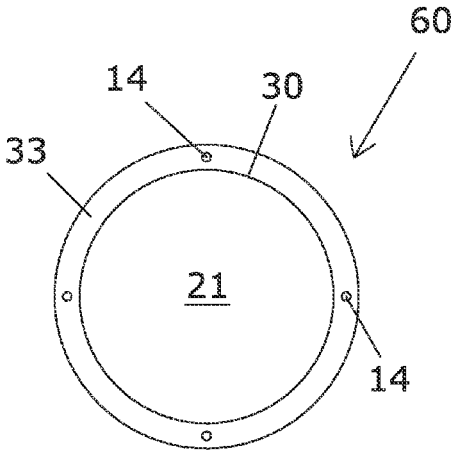
FIG. 11 is a top view showing the solid module 60 of the fourth preferred embodiment of the roof ventilation vent cover of the present invention.
Figure 15:
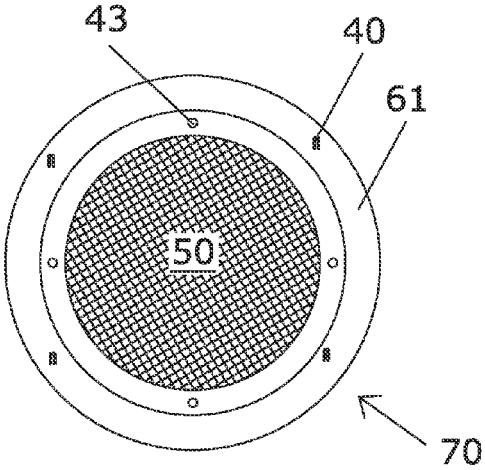
FIG. 15 is a top view showing the screen module 70 of the fourth preferred embodiment of the roof ventilation vent cover of the present invention.

The solid module 60 of FIG. 11 illustrates a circular shape configured to fit over and to cover the screen module 70 of FIG. 15, having side member 30 and also having the solid-module securing members joined to form circular solid-module securing member 33, annularly disposed on the circularly shaped solid module 60, substantially perpendicularly joined to the edge of side member 30. Circular solid-module securing member 33 is configured with holes 14 to receive fastening studs 40, in a similar manner to the first embodiment.

Figure 12:
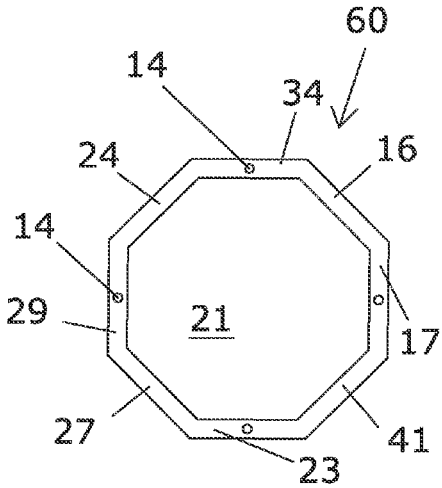
FIG. 12 is a top view showing the solid module 60 of the fifth preferred embodiment of the roof ventilation vent cover of the present invention.
Figure 16:
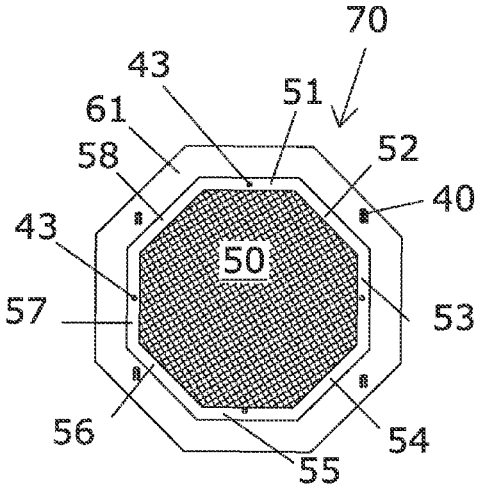
FIG. 16 is a top view showing the screen module 70 of the fifth preferred embodiment of the roof ventilation vent cover of the present invention.

The solid module 60 of FIG. 12 illustrates an octagonal shape configured to fit over and to cover the screen module 70 of FIG. 16, so has eight side members, and also illustrates eight solid-module securing members 16, 17, 41, 23, 24, 27, 29, 34 disposed on the eight sides of octagonally-shaped solid module 60 of FIG. 12, substantially perpendicularly joined to the edges of the eight side members, respectively. Solid-module securing members 16, 17, 41, 23, 24, 27, 29, 34 are configured with holes 14 to receive fastening studs 40.

FIG. 13, FIG. 14, FIG. 15, and FIG. 16 illustrate a second, third, fourth, and fifth exemplary embodiment of the screen module 70 of the present invention. The second, third, fourth, and fifth exemplary embodiments of the screen module 70 are substantially similar to, and function in a similar manner to, the screen module 70 of the first exemplary embodiment of FIG. 2 to FIG. 8, but illustrate the exemplary variations of shape to accommodate the conventional roof ventilation vents commercially available, and therefore, necessarily have a variation in the number of sides comprised by frame member 45, the shape of intermedial screen member 50, the shape of screen-module securing members, and in the position of the holes 43 disposed within frame member 45. Also demonstrated is the possible variation in the mesh aperture size.

The screen module 70 of FIG. 13 illustrates a triangular shape configured to fit over and to cover a triangular vent, such as the conventional triangular gable end vent 25; thus frame member 45 is formed of three side members, 46, 47, and 48. Frame member 45 is configured with holes 43 to receive frame fasteners 44 (FIG. 8), in a similar manner to the first embodiment. The screen module 70 is configured with multiple fastening studs 40, including a third and fourth fastening stud, which are attached to and protrude from planar first screen-module securing member 61 and second screen-module securing member 62, allowing the engagement of solid module 60.

The screen module 70 of FIG. 14 and of FIG. 15 illustrates a circular shape configured to fit over and to cover conventional circular roof ventilation vents. Thus frame member 45 is preferably formed of a single continuous circular side framework 49, and the intermedial screen member 50 is formed in a circular shape. The framework 49 of frame member 45 is configured with holes 43 to receive frame fasteners 44, in a similar manner to the first embodiment.

The screen module 70 is configured with multiple fastening studs 40 which are attached to and protrude from a first screen-module securing member 61 and/or a second screen-module securing member 62, allowing the engagement of solid module 60.

The screen module 70 of FIG. 16 illustrates an octagonal shape configured to fit over and to cover conventional octagonal roof ventilation vents; therefore frame member 45 comprises eight sides, 51, 52, 53, 54, 55, 56, 57, 58. Some or all of the eight sides 51, 52, 53, 54, 55, 56, 57, 58 of frame member 45 are configured with holes 43 to receive frame fasteners 44.

The screen module 70 is configured with multiple fastening studs 40 which are attached to and protrude from a first screen-module securing member 61, allowing the engagement of solid module 60.

In other aspects, the screen module 70 and the solid module 60 of the second, third, fourth, and fifth exemplary embodiment are substantially similar to the screen module 70 and the solid module 60 of the first exemplary embodiment described above.

As will be apparent from the five exemplary embodiments, the multi-module vent cover system 10 of the present invention is well adapted for use with a variety of roof ventilation vents of a variety of sizes, types, and shapes. The screen module 70 and solid module 60 have been shown in conventional vent configurations, meant to illustrate and not to limit the present invention to a particular size, type, or style. The number, size, configuration, and positioning of the various elements of screen module 70 and solid module 60 may be varied as a function of the material, the size, the shape, and the particular specifications of the vent area to be covered, as will be recognized by those skilled in the art.

From the foregoing, it will be apparent that the multi-module vent cover system 10 of the current invention is well adapted to permanently exclude animals from entry into the roof area, while offering removable protection from wind, water, flying debris, fire embers, and/or paint splatters.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

I claim:

1. A vent cover system for installation onto a ventilation vent located on the exterior of a building, said vent cover system comprising:

a screen module adapted to be permanently attached over said ventilation vent on the exterior of said building and; wherein said screen module comprises an intermedial screen member adapted to allow airflow, a generally thin and rigid frame member, a first screen-module securing member extending outwardly from the lateral side of said frame member, an opposing second screen-module securing member extending outwardly from the opposing lateral side of said frame member, first fastening stud extending perpendicularly from said first screen module securing member, and a second fastening stud extending perpendicularly from said second screen module securing member; wherein said frame member forms an exterior framework with an open interior area; wherein said intermedial screen member is disposed within said open interior area of said frame member and attached to said frame member; and wherein said first screen-module securing member and said second screen-module securing member are adapted to be covered beneath a layer of a building material; and a solid module sized to fit over said screen module and configured to be removably attachable to said screen module and configured to restrict airflow, wherein said solid module comprises:

a generally thin, flat, rigid solid-module planar base member having the general shape of said screen module and being sized slightly larger than said screen module, a first and a second generally thin, rigid solid-module planar side member joined to said solid-module planar base member in a substantially perpendicular manner;

a generally thin, rigid planar first solid-module securing member joined to said first side member in a substantially perpendicular manner, said first solid-module securing member configured with a hole to receive said first fastening stud; and a generally thin, rigid planar second solid-module securing member joined to said second side member in a substantially perpendicular manner, said second solid-module securing member configured with a hole to receive said second fastening stud, wherein:

when said solid-module planar base member is attached over said screen module, said solid-module planar base member covers said intermedial screen member, said intermedial screen member is formed of a mesh, said first screen-module securing member is triangular in shape with the wider base of the triangle permanently joined to said frame member and with the apex of the triangle extending outwardly, and said second screen-module securing member is triangular in shape with the wider base of the triangle permanently joined to said frame member and with the apex of the triangle extending outwardly.

2. The vent cover system for installation onto a ventilation vent located on the exterior of a building, as recited in claim 1, wherein said screen module further comprises a third and a fourth fastening stud.

3. The vent cover system for installation onto a ventilation vent located on the exterior of a building, as recited in claim 2, wherein said frame member is formed of a metal.

4. The vent cover system for installation onto a ventilation vent located on the exterior of a building, as recited in claim 3, wherein said metal is aluminum.

5. The vent cover system for installation onto a ventilation vent located on the exterior of a building, as recited in claim 1, wherein said solid module is formed of a metal.

6. The vent cover system for installation onto a ventilation vent located on the exterior of a building, as recited in claim 5, wherein said metal is aluminum.

7. The vent cover system for installation onto a ventilation vent located on the exterior of a building, as recited in claim 1, wherein said mesh is formed of a synthetic fiber.

8. The vent cover system for installation onto a ventilation vent located on the exterior of a building, as recited in claim 1, wherein said mesh is formed of a metal.

9. The vent cover system for installation onto a ventilation vent located on the exterior of a building, as recited in claim 1, wherein said mesh has spaces of a size to exclude rodents.

10. The vent cover system for installation onto a ventilation vent located on the exterior of a building, as recited in claim 1, wherein said mesh has spaces of a size to exclude insects.

11. The vent cover system for installation onto a ventilation vent located on the exterior of a building, as recited in claim 1, wherein said first solid-module securing member, said second solid-module securing member, said solid-module first side member, and said solid-module second side member are formed with rounded edges.

* * * * *